United States Patent [19]

Ryan et al.

[11] 4,004,728

[45] Jan. 25, 1977

[54] MACHINE FILLABLE ENVELOPE

[75] Inventors: James Ryan; Robert W. Vandenberg, both of Fremont, Mich.

[73] Assignee: Gerber Products Company, Fremont, Mich.

[22] Filed: Apr. 18, 1974

[21] Appl. No.: 461,811

[52] U.S. Cl. ..... 229/76; 150/7; 206/260

[51] Int. Cl.[2] ..... B65D 27/20

[58] Field of Search ..... 206/260; 229/68 R, 76; 150/7

[56] References Cited

UNITED STATES PATENTS

| | | | |
|---|---|---|---|
| 2,149,030 | 2/1939 | Moore | 206/260 X |
| 2,166,224 | 7/1939 | Shaw | 206/260 X |
| 2,975,956 | 3/1961 | Robinson et al. | 229/68 R |
| 3,460,744 | 8/1969 | Turkenkopf | 229/68 R X |
| 3,560,025 | 2/1971 | Ostrander | 229/68 R X |

*Primary Examiner*—Stephen P. Garbe
*Attorney, Agent, or Firm*—Townsend and Townsend

[57] ABSTRACT

An improved envelope suitable for interleaving with the pages of a magazine and to be sewed or otherwise bound to the spine of the magazine. The envelope has a front and a back and an entrance for receiving sheet or other material. The back has a lip projecting outwardly from the entrance and a relatively large flap hingedly connected to the outer margin of the lip. When the envelope is moved through a conventional envelope stuffing machine, the lip is held clamped against upward movement as the flap is beneath and contiguous to the back, thereby permitting a suction or other force exerted on the front to lift the latter and thereby open the entrance to facilitate insertion of the material into the envelope.

8 Claims, 3 Drawing Figures

MACHINE FILLABLE ENVELOPE

This invention relates to improvements in the construction of envelopes and, more particularly, to an envelope capable of being used for the machine insertion of material thereinto.

BACKGROUND OF THE INVENTION

Advertising in the form of sheet material can be carried in a packet in a magazine if the packet is in the form of an envelope containing the sheet material and if the envelope is stitched or otherwise bound to the spine of the magazine along with the pages of the magazine. In addition, samples or products in a flat pack or flattened condition, such as plastic wrappers, containers or the like, can also be put in such an envelope and conveyed to the buyer of the magazine. This avoids the need for having to pass such samples out manually, such as at a point of sale in shopping areas and the like.

To utilize such an envelope for advertising materials and for samples of new products, it is desirable to keep all expenses of handling the envelope to a minimum. For this reason, it is much preferred to insert the advertising material and flattened products in the envelope by machine rather than by hand. Manual insertion of the material is not only costly, but also tedious as well. To avoid a large investment in equipment for insertion of such materials into a large number of such envelopes, it is desirable that such envelopes be stuffed or filled by the use of conventional envelope stuffing machines. Such a machine operates to move a plurality of envelopes successively past a stuffing station as the closure flap of each envelope is in an open condition beneath a fixed bar extending along one side of the machine and as the entrance to the envelope is situated so that it can be opened by a suction device above the path of the envelope through the machine.

SUMMARY OF THE INVENTION

The present invention is directed to an envelope which meets the foregoing criteria. To this end, the envelope of this invention utilizes a front and a back with the back having a lip integral therewith and projecting outwardly from the entrance of the envelope. A relatively large flap is hingedly connected to and integral with the outer margin of the lip so that the flap can be moved into a position contiguous to and beneath the back as the envelope moves through a conventional envelope stuffing machine, yet the lip itself can be held down, such as by passing beneath the retainer bar of the machine, to facilitate the opening of the envelope and the insertion of sheet or other such material thereinto. After passing through the machine, the envelope will be in a condition for attachment to the spine of the publication so that the end user can remove the envelope and can close it with the flap attached to the lip. A long flap, substantially equivalent in size to the dimensions of the back of the envelope, has been found necessary to enable the envelope of this invention to be employed with commercially available magazine stitching machines. Envelopes with less than such a full flap are difficult to employ in such conventional equipment.

The primary object of this invention is to provide an improved envelope for use for the insertion of sheet and other material thereinto by the use of conventional envelope stuffing machines while minimizing the expense and labor involved in stuffing the envelopes and providing relatively large flaps having additional advertising or tear-out portions thereon.

Another object of this invention is to provide an envelope of the type described wherein the back of the envelope has a lip integral therewith and projecting outwardly from the entrance area of the envelope so that when the envelope moves through a conventional envelope stuffing machine, the lip can pass beneath the hold-down bar of the machine while the relatively large flap coupled to the lip can underlie the back of the envelope to thereby avoid modification of the machine to accommodate the relatively large size envelope.

Further objects of this invention will become apparent as the following specification progresses, reference being had to the accompanying drawing for an illustration of an embodiment of the envelope. In the drawings.

Figure 1:
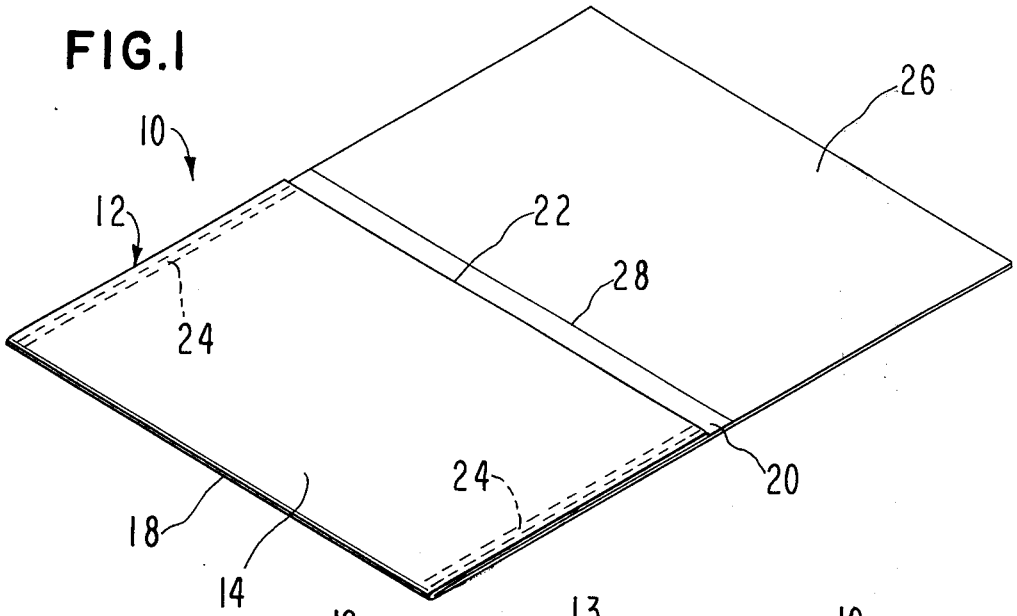
FIG. 1 is a perspective view of the envelope.

The pouch or envelope which is the subject of this invention is broadly denoted by the numeral 10 and includes a materials-receiving paper body 12 formed by a front 14 and a back 16 which are integral with each other at a first fold line 18. Front and back 14 and 16 are generally rectangular and back 16 has a width greater than the corresponding width of front 14 so as to present a lip 20 near the materials-receiving entrance 22 of body 12. The lip is integral with back 16 and coplanar with the same. The body is in the nature of an envelope by virtue of the fact that the front and back are secured together, such as by a narrow adhesive film 24 (FIG. 1) at the side margins of the body.

A rectangular flap 26 is integral with the outer margin of lip 20 and is hinged thereto at a second fold line 28 coincident with the outer margin of the lip. Flap 26 can be pivoted in opposite directions relative to lip 20, and can be moved from a first position contiguous to back 16 (FIG. 4) to a second position contiguous to front 14. In the second position, the flap closes the envelope.

Figure 2:
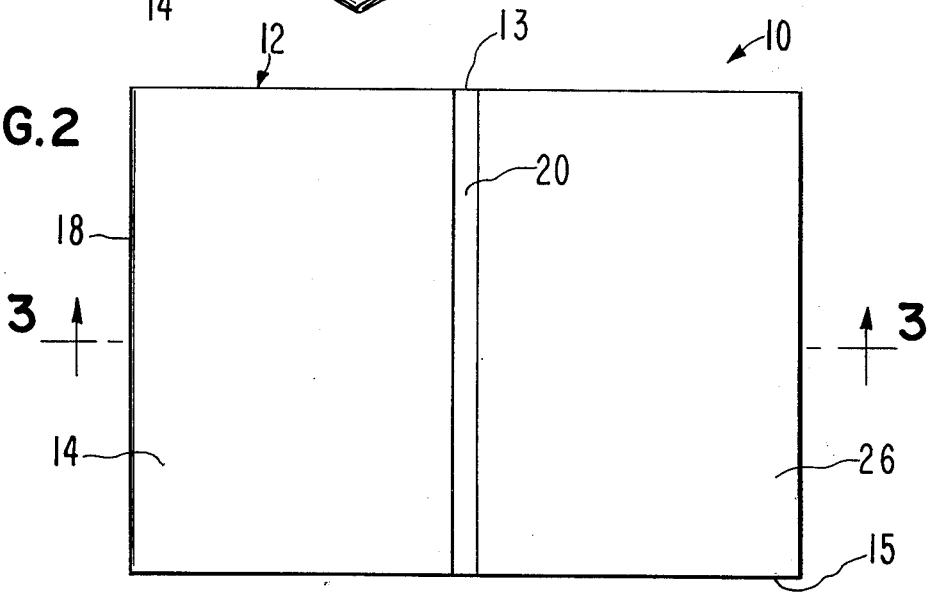
FIG. 2 is a plan view of the envelope.

Envelope 10 is formed from an initially flat sheet of paper having fold lines 18 and 28 formed therein. The fold lines are formed so that flap 26 is substantially of the same length and width as the front 14, and back 16 is greater in width than front 14 and flap 26 but substantially of the same length as the front and the flap as shown in FIG. 2. The length is defined as the distance between side edges 13 and 15 of lip 20 (FIG. 2). Thus, lip 20 is a number of times smaller in width than front 14.

The purpose of lip 20 is to provide a means for holding back 16 in the fixed position (FIGS. 3 and 4) as front 14 is elevated or shifted away from the back during insertion of sheet material or other articles into the envelope and as flap 26 is contiguous to and beneath back 16. Thus, the envelope is suitable for passing through a conventional envelope stuffing machine 29 (FIGS. 3 and 4) even though the envelope has a relatively large flap 26. Thus, materials can be inserted by the machine into the envelope to eliminate the need for manual insertion of such materials.

Figure 3:
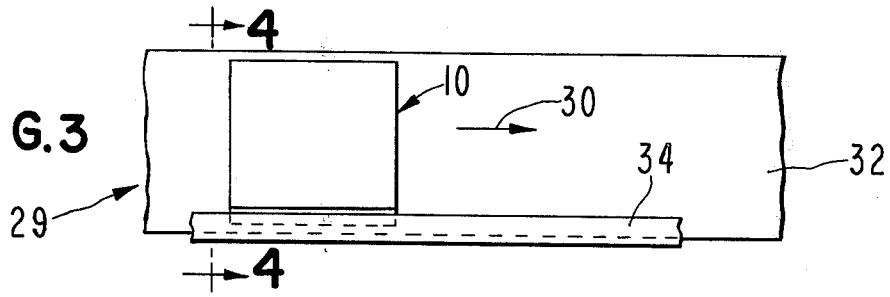
FIG. 3 is a top plan view of a portion of a conventional envelope stuffing machine showing the way in which the envelope moves therethrough.
Figure 4:
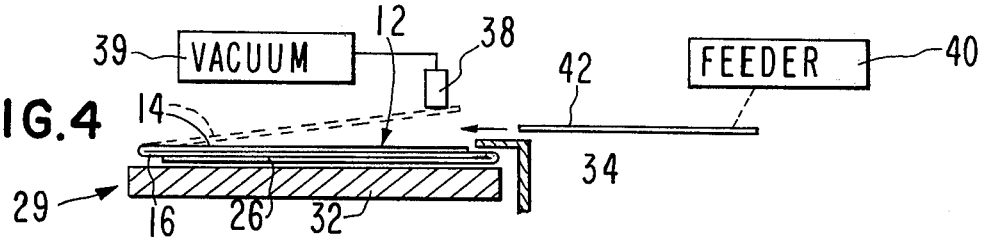
FIG. 4 is a cross-sectional view taken along line 4—4 of FIG. 3.

A typical machine operable sequence involving envelope 10 is shown in FIG. 4 wherein the envelope is moved through machine 29 in a direction of arrow 30 by a conveyor 32. The envelope is initially placed on the conveyor with flap 26 contiguous to and beneath back 16 with lip 20 adjacent to and extending along one side of the conveyor as shown in FIG. 3. Thus, the envelope will be supported in a generally horizontal position as it is moved by the conveyor. The machine has a hold-down bar 34 adjacent to the side of the conveyor at which lip 20 is disposed. Bar 34 is adapted to overlie lip 20 as the envelope moves in the direction of arrow 30 whereby lip 20 and thereby back 16 are held against upward movement.

Machine 29 further includes one or more suction devices 38 coupled to a vacuum source 39 with the suction device disposed above the path of travel of the envelope to cause the entrance to the envelope to be opened when the envelope approaches and is adjacent to a feeder mechanism 40 adjacent to one side of conveyor 32.

When the entrance is opened, mechanism 40 operates to feed sheet material 42 into the envelope as lip 20 remains beneath bar 34 as shown in FIG. 4. Lip 20 is designed so that it can be restrained below hold-down bar 34 without interfering with the insertion of sheet material 41 into envelope body 12. As soon as the envelope passes feeder 40, the vacuum is removed from device 38, allowing front 14 to descend and to allow the entrance of the envelope to at least close to a certain extent. The conveyor advances the envelope to a collection station from whence it is made ready for insertion into a magazine or the like.

We claim:

1. An envelope for use in the machine insertion of material therein comprising: a flat, sheet-like body having a front, a back, and an opening adjacent to one end margin of said front to permit materials to be inserted into the body and disposed between said front and said back, the back having a lip projecting outwardly from the opening, there being an adhesive-free closure flap hingedly connected to the outer margin of the lip underlying said back and contiguous therewith in a first position wherein said lip can be held in place as materials are directed into the body through said opening, said flap being movable to a second position overlying said front and contiguous therewith wherein said closure flap closes said opening.

2. An envelope as set forth in claim 1, wherein the flap is of substantially the same size as said front, said back being larger in size than said front.

3. An envelope as set forth in claim 1, wherein the lip is a number of times smaller in width than the front.

4. An envelope as set forth in claim 1, wherein the lip and the flap are integral with each other, there being a line of weakness at the junction between the lip and the flap to form said hinge connection therebetween.

5. An envelope as set forth in claim 1, wherein the lip has the same width as the front and back, the latter being generally rectangular.

6. An envelope as set forth in claim 1, wherein the body is formed from an initially flat sheet of paper having a pair of parallel fold lines, one of the fold lines defining one end of the body and the other fold line defining the outer margin of said lip, and including adhesive means bonding said front and back together at the side margins thereof.

7. An envelope as set forth in claim 1, wherein said lip is integral with said back and coplanar with the same.

8. An envelope as set forth in claim 1, wherein the flap is of substantially the same size as said front, said back being larger in size than said front, the lip being a number of times smaller in width than said front, the lip and the flap being integral with each other, said body being formed from an initially flat sheet of paper having a pair of parallel fold lines, one of the fold lines defining one end of the body and the other fold line defining the outer margin of said lip, and including adhesive means bonding said front and back together at the side margins thereof.

* * * * *